US006779945B2

(12) United States Patent
Saffo, Sr.

(10) Patent No.: US 6,779,945 B2
(45) Date of Patent: Aug. 24, 2004

(54) APPARATUS FOR LEVELING AND SMOOTHING OF CONCRETE

(76) Inventor: Richard E. Saffo, Sr., Box 11, Howe Hill Rd., Woodsville, NH (US) 03785

( * ) Notice: Subject to any disclaimer, the term of this patent is extended or adjusted under 35 U.S.C. 154(b) by 347 days.

(21) Appl. No.: 10/052,898

(22) Filed: Jan. 16, 2002

(65) Prior Publication Data

US 2004/0076471 A1 Apr. 22, 2004

Related U.S. Application Data

(63) Continuation-in-part of application No. 09/464,318, filed on Dec. 16, 1999, now Pat. No. 6,379,080.
(60) Provisional application No. 60/113,060, filed on Dec. 21, 1998.

(51) Int. Cl.[7] ..... E01C 19/22
(52) U.S. Cl. ..... 404/118
(58) Field of Search ..... 15/235.4, 235.8; 404/114, 118; 37/265, 284, 285

(56) References Cited

U.S. PATENT DOCUMENTS 867,852 A * 10/1907 Switzer et al. ..... 404/118
4,397,581 A 8/1983 Jarvis ..... 404/97
4,723,869 A 2/1988 Dragich ..... 404/97
4,861,188 A * 8/1989 Rouillard ..... 404/75
5,549,413 A * 8/1996 Bolden ..... 404/93
5,727,279 A 3/1998 Pike ..... 15/235.4
5,980,154 A 11/1999 Record ..... 404/97
5,984,571 A 11/1999 Owens ..... 404/97

* cited by examiner

*Primary Examiner*—Gary S. Hartmann
(74) *Attorney, Agent, or Firm*—George W. Dishong

(57) ABSTRACT

An apparatus for leveling and smoothing a substance such as concrete and drawing up paste in one motion. The apparatus has a leveling blade with a straight edge and a smooth-surfaced float. The float attaches to the leveling blade by a connecting strip of resilient material, which permits the position of the float to contour to the concrete surface. The connecting strip, adjacent to the float, contacts the concrete surface to pull up cement paste, which creates a more workable surface. The leveling blade attaches to the handle by a mount. The mount and handle are adjustable to add additional length to the apparatus for use on various sized concrete surfaces. A vibratory mechanism can also be attached to the apparatus to assist in leveling and smoothing concrete.

19 Claims, 6 Drawing Sheets

APPARATUS FOR LEVELING AND SMOOTHING OF CONCRETE

CROSS REFERENCE TO RELATED APPLICATIONS

The present application is a continuation-in-part of U.S. Utility patent application Ser. No. 09/464,318 filed Dec. 16, 1999 now U.S. Pat. No. 6,379,080, and claims priority to U.S. Provisional Patent Application Ser. No. 60/113,060 filed Dec. 21, 1998.

BACKGROUND OF THE INVENTION

This invention relates to devices for leveling and smoothing a substance such as concrete, particularly when the substance is freshly placed. More particularly, this invention relates to an apparatus for leveling, enhancing the mixture, and smoothing a freshly placed substance such as concrete using a leveling blade, a connecting strip, and a smoothing float. Even more particularly, this invention relates to an apparatus for leveling and smoothing a freshly placed substance such as concrete in one step by a single operator.

There are many tools used today by concrete workers to smooth a surface of concrete. Typical smoothing tools, for example screeds and trowels, allow workers to smooth the surface of freshly poured concrete or similar viscous hardening substance. Concrete-working tools range from the very simple, hand-held variety to complex motorized units that use means for vibrating at least a portion of the tool to aid in settling the concrete. Concrete-smoothing methods can involve such aids as rails constructed along the edges of the concrete project that are fitted with a screed that is moved across the rails. The following patents provide examples of the current art in concrete-working tools and methods.

U.S. Pat. No. 5,727,279 discloses a tool for grading, leveling, and sealing wet concrete. The grading head is triangular, hollow, made of aluminum, floats on top of the wet concrete, and is attached to a long handle. The head is attached to the handle through an attachment block. There are also support members that maintain the head's position with respect to the handle. In this invention, the angle between the leg of the triangular head that accomplishes leveling and the leg that performs the smoothing function cannot be varied to accommodate surface-sensitive smoothing. Also, there is no way to vary the material of which the smoothing surface is constructed, allowing for both drawing up the paste in the mixture and smoothing in one leveling cycle.

U.S. Pat. No. 4,397,581 discloses an aluminum hand trowel/bull float that combines features of grooving, leveling, and smoothing in one tool. The float has a handle that can be lengthened and the angle of the handle with respect to the float can be adjusted so that a worker can level the concrete at close range or from a distance. The moving and shifting of concrete by means of this device in accomplished through front and back walls vertically extending from the surface of the float. This device also accommodates weights. As in the previous invention, the angle between the leveling surface and the smoothing surface is constant, and there is no variation of materials possible to accommodate drawing up of paste from the mixture.

U.S. Pat. No. 4,723,869 discloses a semi-rigid, yet flexible, blade assembly made of sheet metal or plastic with a long handle and ribbed reinforcement. This device is intended to be used with weights attached and is designed so that the edges of the blade are allowed to flex vertically during the leveling process. This device is geared for leveling, not smoothing. Leveling and smoothing would be a two-step process using this device. This device cannot accommodate a means for vibration.

U.S. Pat. No. 5,984,571 discloses a vibrating screed that permits selective adjustment of the angle between the axis of a rotatable eccentric and the plane defined by the bottom of the screed plate to vary the relative vertical compaction and horizontal smoothing oscillation movement imparted by the eccentric. The screed includes a frame, motor, an eccentric driven by the motor, a screed plate, and a pair of locking hinges. This device contains a handle-mounted throttle for adjusting the motorized vibration and other automatic features. This device is relatively complex for the one-person cement-leveling job. It allows for changes in horizontal and vertical orientation of the leveling blade, and automatic vibration. This device does not accommodate the drawing up of the paste.

U.S. Pat. No. 5,980,154 discloses a manual screeding system for use in leveling freshly poured concrete that includes a frame for providing structural integrity to the screed. The screeding system includes handles, attached to the frame, for manually holding and manipulating the screeding system during the screeding process. A support, attached to the frame, is provided for preventing the screeding system from rotating about the handles during the screeding process. The support is structured to engage the forearms of the user when the screeding system is in use. A pair of bracket assemblies is provided for securely holding a screed board to the frame. This system requires another structure to accomplish leveling and smoothing of the concrete surface, and does not accommodate mixture enhancement as described above. There is no means for vibration possible with this device.

BRIEF SUMMARY OF THE INVENTION

The present invention, in its most simple embodiment, is an apparatus for the leveling and smoothing of a substance such as concrete. The apparatus includes a leveling blade operated in conjunction with a smoothing float, the leveling blade crossing the material in advance of the smoothing float, and both being pulled, perhaps by a shaft-like handle, so that the operator can, using the handle, smooth a floor surface while standing erect. The invention levels and smoothes a substance such as concrete by striking off excess substance using a leveling blade while simultaneously smoothing the surface with a float that follows the leveling blade. At the same time, the apparatus draws up the paste from the substance mixture.

The apparatus of the present invention includes a smoothing float having (1) a smoothing surface that opposes a blade-connecting surface, (2) a leveling blade that has an edge formed between two opposing surfaces: a float-connecting surface and a pull-connecting surface, (3) a resilient connection between the float-connecting surface and the blade-connecting surface; the resilient connection binds the leveling blade to the smoothing float, and allows the angle between the leveling blade and the smoothing float to vary, and (4) a pulling means, which may be a handle, that has two ends; one end is for a pulling force, perhaps an operator or a piece of machinery, to grasp and pull the apparatus, the other end is connected to the leveling blade. Further, the leveling blade and float can be resiliently connected as follows: they can both be connected to three of the sides of the connecting strip by any form of a means for connecting. The means for connecting may include sheet rock screws, bonding adhesive, and other connecting devices. The pulling means is mounted directly to the leveling blade or to a mounting bracket connected to the leveling blade. The pulling means may consist of a single length or include means for extension. The mounting bracket may be of a fixed variety or include means for articulation. The mounting bracket and the pulling means may be of generally known types in the art.

Most preferably, the present invention is comprised of a leveling blade and a float made of aluminum or rubber. The resilient means of connection between the float and the leveling blade, namely the connecting strip, may be any resilient material including wood, magnesium, rubber, and a variety of plastics. The preferable material of the connecting strip has a cement-pulling tendency. Most generally, the invention may be constructed of any suitable materials.

In operation, the apparatus pulling means attached to the leveling blade allows the operator or a piece of machinery to pull the leveling blade forward followed by the float. The leveling blade levels and smoothes an underlying substance such as concrete by striking off excess substance with the leveling blade. Simultaneously, the float follows, smoothing the substance following the leveling blade. If the present invention is used with concrete, the connecting strip can be made of material that has a property of causing cement paste in the concrete to float to the surface. Resilient properties of the connection between the connecting strip and the leveling blade allow the angle of the smoothing float with respect to the leveling blade to change. This dynamic relationship is important in that the float will remain substantially level with the surface of the substance, the leveling blade remains at an operational, though varying, angle with respect to the surface, and the handle angle can vary depending upon the position of the operator.

One advantage of the present invention is the lightweight construction. The use of durable, lightweight materials such as aluminum allows one person to transport and operate the invention.

Another advantage of the present invention is the multi-function design. In one motion the invention levels the freshly poured concrete leaving a smooth surface, This design includes a leading leveling blade to strike off excess concrete and an aluminum float that follows to level and smooth concrete.

Yet, another advantage of the present invention is one person operation. The lightweight design combined with the multi-function design allows one person to smooth with economy a concrete floor.

Still yet, another advantage of the present invention is the handle that allows the user to operate the level and float at a distance while standing upright. This aspect allows the worker to smooth a greater area in a limited amount of time and permits the worker to stay outside of the poured concrete.

Yet still another object of the present invention is to provide an apparatus for leveling and smoothing a material such as concrete in which the pulling means is connected by a mounting bracket connected directly to a pull-connecting surface of the leveling blade.

Yet still another object of the present invention is to provide an apparatus for leveling and smoothing a material such as concrete in which there is a vibrating means attached to the surface of the leveling blade that faces the operator.

These and further objects of the present invention will become apparent to those skilled in the art after a study of the present disclosure of the invention.

DETAILED DESCRIPTION OF THE INVENTION

Figure 1:
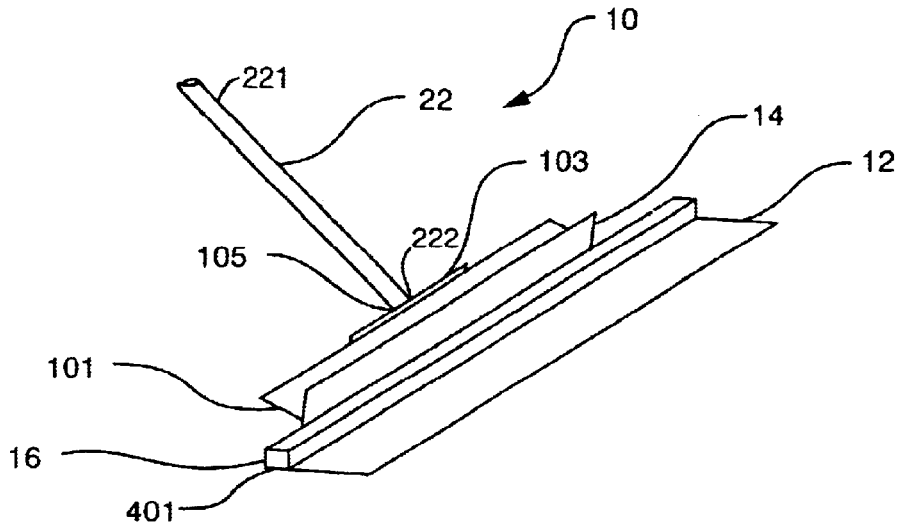
FIG. 1 is a perspective view of the leveling and smoothing apparatus.
Figure 2:
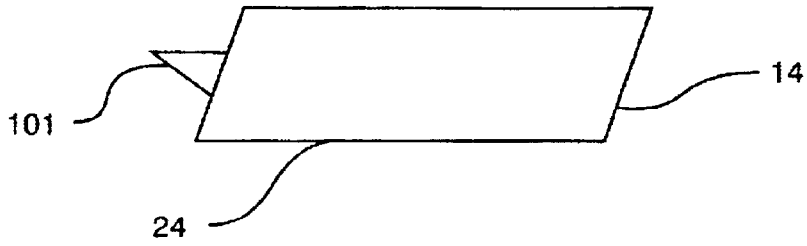
FIG. 2 is a perspective view of the leveling blade with toothed edge and handle connection means shown.
Figure 4:
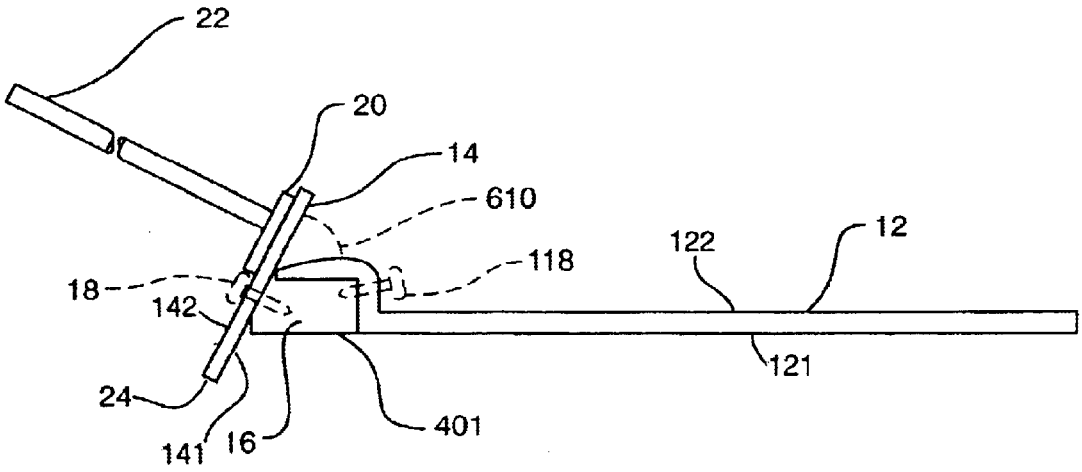
FIG. 4 is a side view of the leveling and smoothing apparatus with connection means between the leveling blade and the connecting strip shown.

Referring to FIG. 1, the illustrative embodiment of apparatus 10 includes smoothing float 12, leveling blade 14, connecting strip 16, and handle 22. Smoothing float 12 includes a smoothing surface 121 and an opposing blade-connecting surface 122. Leveling blade 14 includes edge 24 formed between a float-connecting surface 141 and an opposing pull-connecting surface 142 as shown in FIGS. 2 and 4. A resilient connection, connecting strip 16 in the illustrative embodiment, joins float 12 to leveling blade 14 through connecting means 18. Connecting strip 16 joins float-connecting surface 122 with blade-connecting surface 141 forming angle 610, which can theoretically vary between 0° and 360°, but in the illustrative embodiment varies between about 0° and 90°. Angle 610 varies during operation so that float 12 remains flush against the concrete surface being leveled. In the illustrative embodiment, connecting strip 16 is joined to float 12 either with a bonding material or other fasteners, e.g. screw 118.

Figure 3:
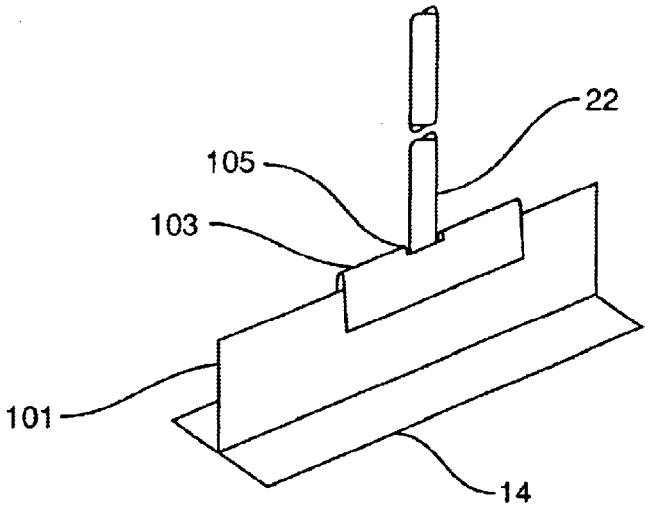
FIG. 3 is a perspective view of the leveling blade with handle connection means and handle shown.

A pulling means, handle 22 in the illustrative embodiment, includes a pulling end 221 and a blade-connecting end 222, as shown in FIG. 1. The blade-connecting end 222 matingly attaches to the pull-connecting surface 142 through a variety of possible mechanisms. The mating attachment can be rigid, as shown in FIG. 1, or can be articulated, as shown in FIG. 8B. In the illustrative embodiment, handle 22 can be connected to the pull-connecting surface 142 of leveling blade 14 through a combination of attached strip 101, mounting strip 103, and handle attachment means 105 as shown in FIG. 3. In an alternate embodiment, handle 22 can also be connected to leveling blade 14 by means of mounting bracket 20 shown in FIGS. 4–7.

Figure 5:
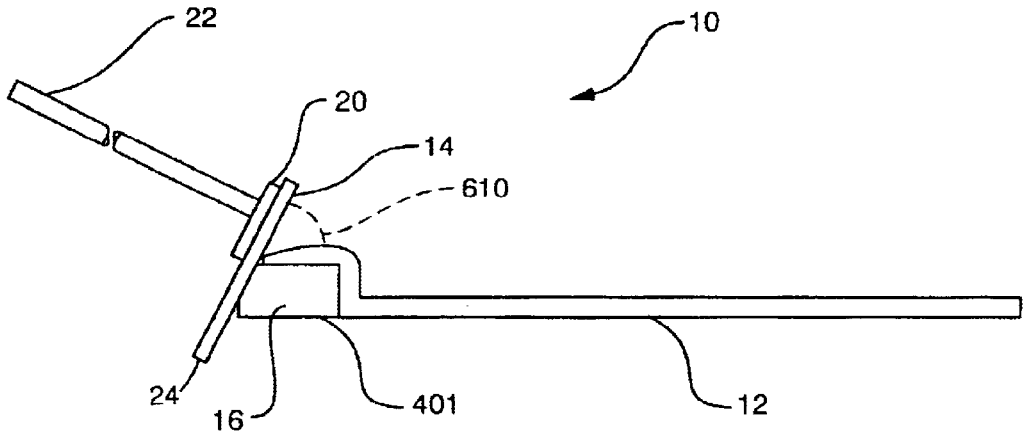
FIG. 5 is a side view of the leveling and smoothing apparatus showing an operational orientation of the leveling blade, i.e. at an acute angle with respect to the smoothing float.

In the illustrative embodiment, when the operator pulls handle 22, leveling blade 24 scrapes away any excess viscous material such as concrete and creates a level surface. Following leveling blade 24, float 12 acts as a trowel to smooth the level surface created by blade 24. The leveling blade and the smoothing float operate cooperatively. The resilient properties of connecting strip 16 joining leveling blade 14 to float 12 allow the angle of float 12 with respect to leveling blade 14 and handle 22 to vary depending on the surface over which float 12 is pulled, allowing float 12 to remain substantially flat with respect to the surface being smoothed while dynamic forces act on leveling blade 24 and handle 22 as apparatus 10 is moved across the surface. Downwardly exposed portion 401 of connecting strip 16 as shown in FIGS. 4–6 may additionally create a reaction that pulls up paste from the concrete mixture and provides a more workable surface.

Figure 8A:
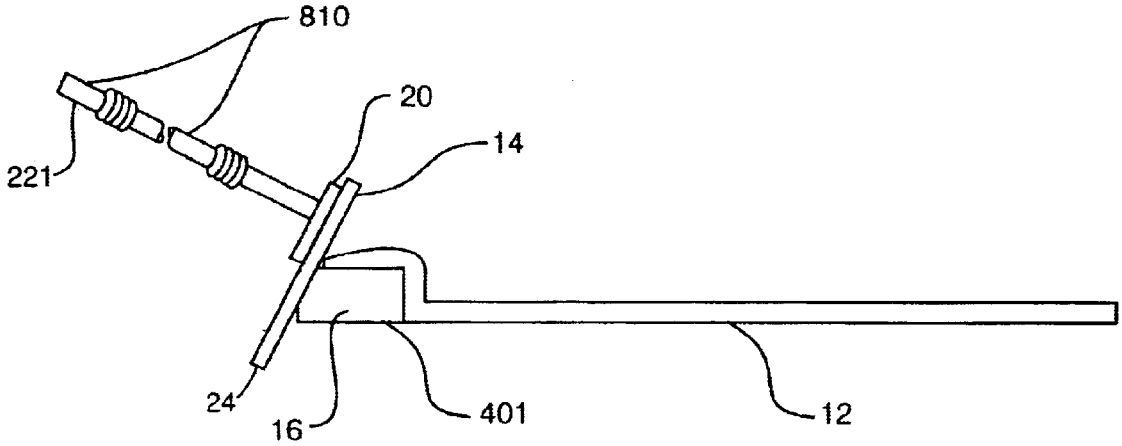
FIGS. 8A and 8B depict views of the extendable and articulated handle, respectively.
Figure 8B:
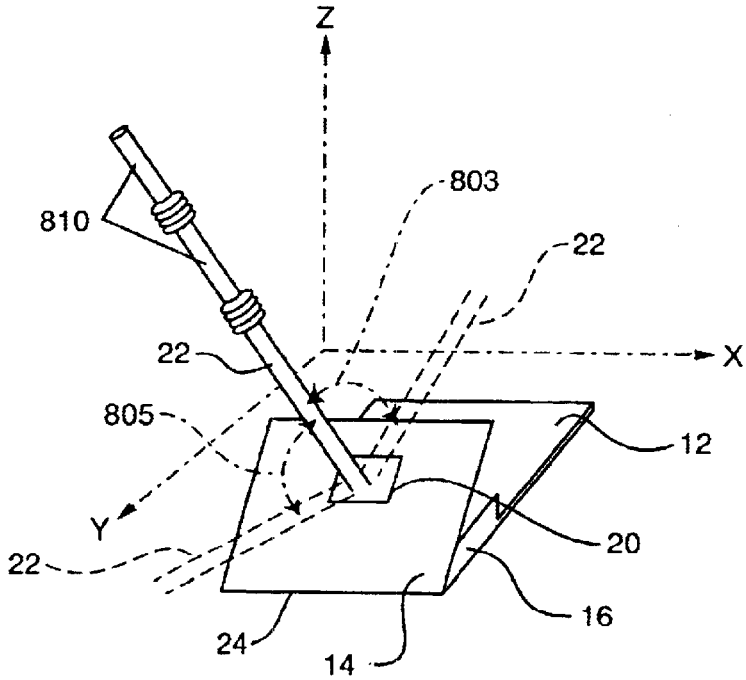

In the illustrative embodiment, additional handle extensions 810 to elongate pulling end 221 as shown in FIG. 8A may be added to handle 22 to permit the operator to extend the invention further into the concrete working area while not stepping on the freshly-poured concrete. Handle 22 can be of a variety that articulates with respect to mounting bracket 20 to permit vertical angle 805, and horizontal angle 803, as shown in FIG. 8B, or both vertical and horizontal articulation.

Figure 6:
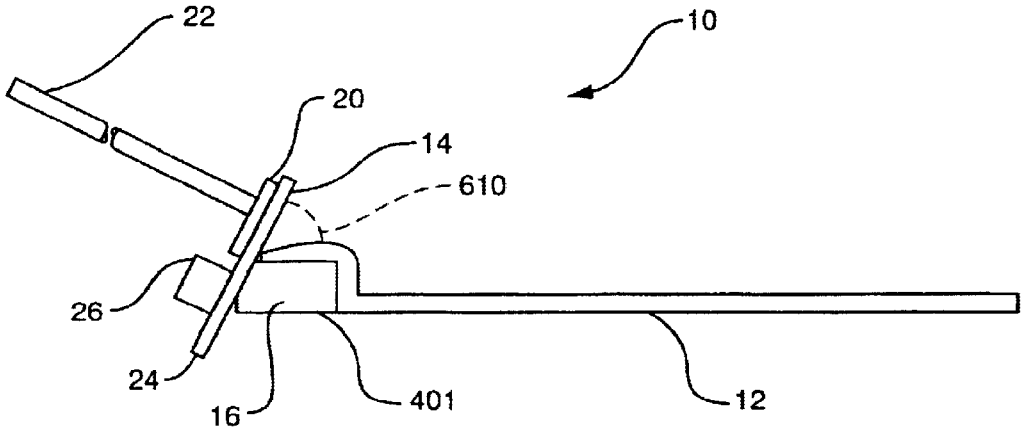
FIG. 6 is a side view of the leveling and smoothing apparatus showing a vibrating means positioned on the shaft of the handle.
Figure 7:
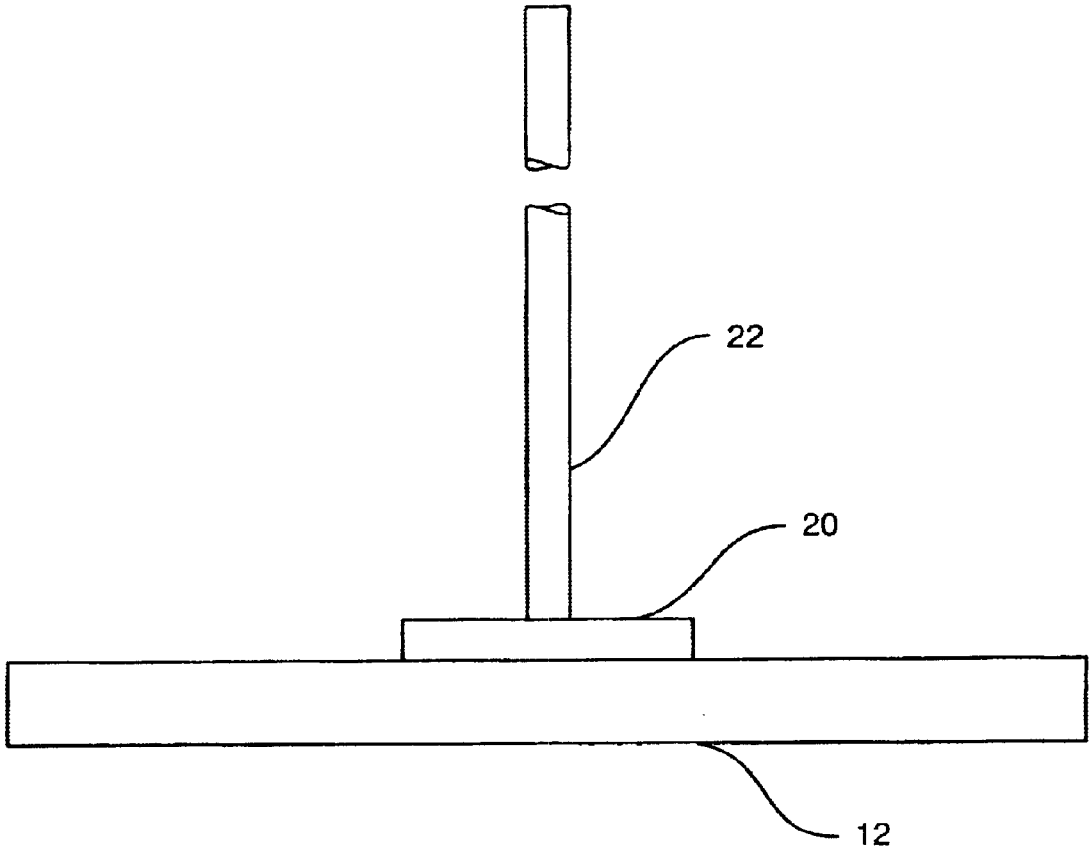
FIG. 7 is a plan view showing the handle directly connected by a mounting bracket to the leveling blade.

Referring now to the alternate embodiment of FIG. 6, a means for vibration 26 is used to aid in leveling and smoothing concrete. Means of vibration 26 may be any commonly known in the art. Means for vibration 26 can be powered by any known means, including a DC battery or AC electrical wire. Means for vibration 26 can be mounted on leveling blade 24 near handle attachment 20, or any other commonly known mount point.

Figure 9:
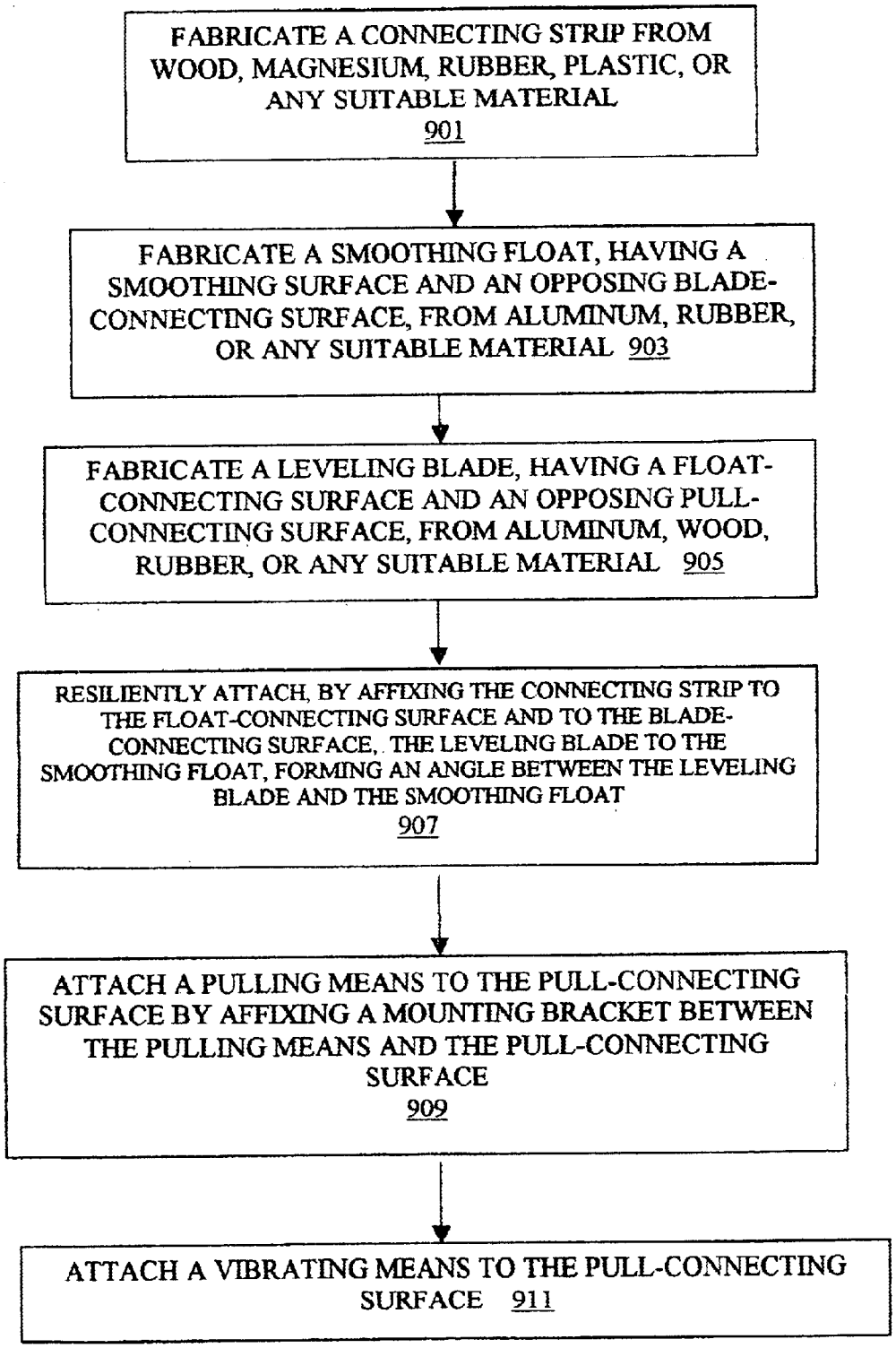
FIG. 9 is a flowchart of the illustrative embodiment of the method of making the apparatus of the present invention.

Referring now to FIG. 9, the illustrative embodiment of the method of making the apparatus of the present invention is shown. First a resilient connecting strip 16 is fabricated (method step 901), followed by the fabrication of the smoothing float 12 (method step 903) and the leveling blade 14 (method step 905). Next the connecting strip 16 is attached to the float-connecting surface 141 and the blade-connecting surface 122 (method step 907). As shown in FIG. 4, in the illustrative embodiment, smoothing float 12 is shaped to be attached to two surfaces of connecting strip 16 which, in the illustrative embodiment, includes four or five surfaces, depending on the attachment point of blade 14. Float-connecting surface 141 attaches resiliently to a connecting strip surface that is not already attached to smoothing float 12. Thus, the angle 610 between float-connecting surface 141 and blade-connecting surface 122 can vary. Next pulling means 22 is attached to pull-connecting surface 142 (method step 909). A mounting bracket 20 or any suitable type of attachment can be used. Finally and optionally, a vibrating means 26 can be attached to the pull-connecting surface 142 (method step 911).

The illustrative embodiment is herein described to provide the best illustration of the principles of the invention, but not to limit modifications allowed under this description and claims. The disclosed embodiments enable one of ordinary skill in the art to use the invention with various modifications. All such modifications and variations are within the scope of the invention as determined by the appended claims.

I claim:

1. An apparatus for leveling and smoothing comprising:

a smoothing float having a smoothing surface, said smoothing surface adjacent a blade-connecting surface;

a leveling blade having an edge formed between a float-connecting surface and an opposing pull-connecting surface;

a resilient connection between said float-connecting surface and said blade-connecting surface, said resilient connection forming an angle between said float-connecting surface, and said blade-connecting surface, said angle ranging from 0° to 180°; and a pulling means, said pulling means having a pulling end and a blade-connecting end, said blade-connecting end having a mating attachment to said pull-connecting surface, said mating attachment connecting said pulling means to said leveling blade.

2. The apparatus as in claim 1 wherein said smoothing float is made from material selected from a group consisting of aluminum and rubber.

3. The apparatus as in claim 1 wherein said leveling blade is made from material selected from a group consisting of aluminum, wood, and rubber.

4. The apparatus as in claim 1 wherein said resilient connection comprises a connecting strip, said connecting strip having cement-pulling properties.

5. The apparatus as in claim 1 wherein said connecting strip is made from material selected from a group consisting of wood, magnesium-based metal, rubber, and plastic.

6. The apparatus as in claim 1 wherein said pulling means is selected from a group consisting of a handle, a rope, and a chain.

7. The apparatus as in claim 1 wherein said mating attachment is selected from a group consisting of rigid and articulated.

8. The apparatus as in claim 1 wherein said mating attachment comprises a mounting bracket.

9. The apparatus as in claim 1 further comprising a vibration means, said vibration means being attached to said pull-connecting surface.

10. The apparatus as in claim 1 wherein said pulling end further comprises an extension means for elongating said pulling end.

11. A method for making an apparatus for leveling and smoothing comprising the steps of:

fabricating a connecting strip;

fabricating a smoothing float, the smoothing float having a smoothing surface and an adjacent blade-connecting surface;

fabricating a leveling blade, the leveling blade having a float-connecting surface and an opposing pull-connecting surface;

resiliently attaching the connecting strip to the float-connecting surface and the blade-connecting surface, said step of resiliently attaching having the effect of forming an angle between the leveling blade and the smoothing float in the range of 0° and 180°; and matingly attaching a pulling means to the pull-connecting surface.

12. The method of claim 11 further comprising the step of:

attaching a vibrating means to the pull-connecting surface.

13. The method as in claim 11 further comprising the step of:

selecting smoothing float material from a group consisting of aluminum and rubber.

14. The method as in claim 11 further comprising the step of:

selecting leveling blade material from a group consisting of aluminum, wood, and rubber.

15. The method as in claim 11 further comprising the step of:

selecting connecting strip material from a group consisting of materials having cement-pulling properties.

16. The method as in claim 11 further comprising the step of:

selecting connecting strip material from a group consisting of wood, magnesium-based metal, rubber, and plastic.

17. The method as in claim 11 further comprising the step of:

selecting the pulling means from a group consisting of handles, ropes, and chains.

18. The method as in claim 11 farther comprising the step of:

fabricating the pulling means to be extendible.

19. The method as in claim 11 wherein said step of matingly attaching further comprises the step of:

affixing a mounting bracket between the pulling means and the pull-connecting surface.

* * * * *